US005916625A

United States Patent [19]

Rosenberger et al.

[11] Patent Number: 5,916,625

[45] Date of Patent: Jun. 29, 1999

[54] METHOD AND APPARATUS FOR SPRAYING WATERBORNE COATINGS UNDER VARYING CONDITIONS

[75] Inventors: Mary Ellen Rosenberger, Bay Village, Ohio; Donald B. Jones, Wildwood, Pa.

[73] Assignee: PPG Industries, Inc., Pittsburgh, Pa.

[21] Appl. No.: 08/044,436

[22] Filed: Apr. 8, 1993

[51] Int. Cl.[6] ..... B05D 1/02; B05D 1/34

[52] U.S. Cl. ..... 427/8; 427/421; 427/426; 118/326; 118/663; 118/666

[58] Field of Search ..... 427/8, 421, 426; 118/326, 663, 666

[56] References Cited

U.S. PATENT DOCUMENTS

| | | | |
|---|---|---|---|
| 3,979,535 | 9/1976 | Govindan | 427/422 |
| 4,007,306 | 2/1977 | Poy et al. | 427/377 |
| 4,132,357 | 1/1979 | Blackinton | 239/11 |
| 4,341,821 | 7/1982 | Toda et al. | 427/299 |
| 4,344,991 | 8/1982 | Gray | 427/325 |
| 4,396,651 | 8/1983 | Behmel et al. | 427/421 |
| 4,554,887 | 11/1985 | Yoakam et al. | 118/666 |
| 4,687,686 | 8/1987 | Stofleth et al. | 427/421 |
| 4,738,219 | 4/1988 | Fujisawa | 118/666 |
| 5,127,362 | 7/1992 | Iwatsu et al. | 118/667 |

FOREIGN PATENT DOCUMENTS

78/005048 2/1978 Japan .

OTHER PUBLICATIONS

W. Burckhardt and H. J. Luthardt, "Water–borne industrial thermosetting systems: Physical chemical behaviour of their components and aspects of application technology", J. Oil Col. Chem. Assoc., 1979, 62, pp. 375–385.

*Primary Examiner*—Shrive Beck
*Assistant Examiner*—Bret B. Chen
*Attorney, Agent, or Firm*—Dennis G. Millman

[57] ABSTRACT

The detrimental effects of fluctuating humidity are neutralized by adjusting the viscosity of a waterborne coating as it is being conducted to the spraying device. A predetermined amount of water or other viscosity modifying additive is mixed continuously with the coating in the coating supply line immediately upstream from the spray device. The amount of water or other additive to be added may be determined by monitoring the humidity in the spray zone. Preferably, an automated feedback control system is employed to adjust the amount of water or other viscosity altering additive being mixed into the coating stream.

4 Claims, 1 Drawing Sheet

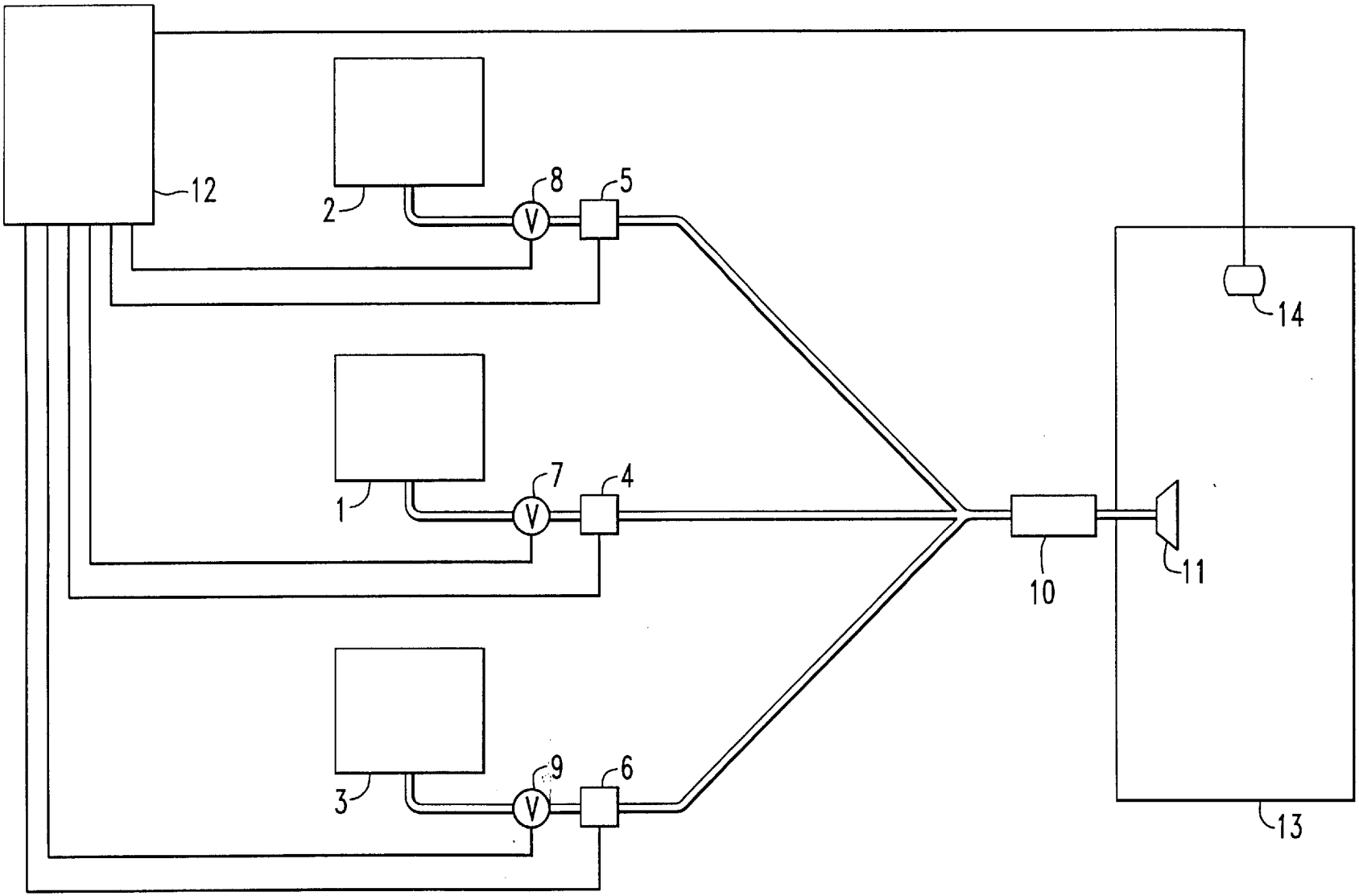
14
13
11
10
5
4
6
8
7
9
2
1
3
12

METHOD AND APPARATUS FOR SPRAYING WATERBORNE COATINGS UNDER VARYING CONDITIONS

BACKGROUND OF THE INVENTION

The present invention relates to a method and apparatus for applying waterborne coating compositions and to the resultant coated articles Waterborne coating compositions have become increasingly important today due to organic volatile emissions regulations. Waterborne coating compositions are utilized to meet these regulations because the waterborne coating compositions contain much smaller amounts of organic volatiles than conventional solvent coating compositions The application of waterborne coatings is complicated by the fact that the evaporation rate of water is dependent on the relative humidity of the spray environment. When the percent relative humidity is high (e.g., greater than 80%) water does not evaporate at a fast enough rate and "wet" paint films are produced. "Wet" films have a tendency to sag, pop, and in cases of metallic pigmented coatings produce dark, mottled films that exhibit areas of non-uniform distribution of the metallic pigment. Sags are unsightly, gravity driven flows that occur on vertical surfaces, and pops are small pore-like flaws in the coating that are caused by the violent evolution from the film of trapped solvent (either organic solvent or water). Conversely, when the percent relative humidity is low (e.g., less than 50%) water evaporates too quickly, and "dry" paint films are produced. "Dry" films tend to be rough and do not exhibit good leveling and flow characteristics.

There have been a number of attempts to overcome these problems, but none of them have been particularly successful. One approach has been to try to control the atmosphere in the spray booth or spray zone. U.S. Pat. Nos. 3,979,535 and 4,687,686 describe methods of controlling the temperature and humidity of the air in the spray booth to acceptable preset levels. If, however, the spray booth is not enclosed and is instead open to a work room or plant, it may be very difficult and expensive to control the temperature and humidity in the whole room or plant. Sometimes it is not feasible or desired to enclose the spray area.

U.S. Pat. No. 4,132,357 describes a method of applying solvent-thinned coatings utilizing a shroud which delivers air at a controlled temperature and humidity around the atomized spray, forming a controlled localized atmosphere. However, ambient air from the spray booth may mix with this controlled atmosphere as it passes from the spray gun to the article being coated, and the controlled atmosphere may dissipate very rapidly.

Another approach is to add water to the paint film to control evaporation of water from the film. U.S. Pat. No. 4,344,991 describes depositing a mist layer of water on top of or beneath the deposited waterborne coating by simultaneously atomizing water with ancillary nozzles. The water mist is not intended to intermix with the atomized waterborne coating. U.S. Pat. No. 4,396,651 describes a coating process in which water is atomized through nozzles ancillary to the main spray nozzle. The atomized water is said to build a uniform water atmosphere around the waterborne coating atomized stream without being homogeneously mixed with the coating. Both of these patents describe approaches that have problems with nozzle configuration complexities and have problems with accurately controlling the amount of water deposited or added to the constantly changing atmosphere around the atomized spray.

U.S. Pat. No. 4,341,821 describes spraying an organic solvent onto a coated article either before, after, or at the same time the waterborne coating is being applied. The solvent is intended to control the viscosity of the waterborne coating to prevent sagging. Spraying solvent defeats the main purpose of using waterborne coatings.

It would be desirable to overcome the problem of applying waterborne coatings compositions at varying relative humidities while avoiding the disadvantages of the prior art approaches. In particular, it would be desirable to avoid batch mixing of coatings with solvents, to avoid complicated, non-standard spray gun structures, and to avoid costly humidity control schemes.

SUMMARY OF THE INVENTION

It has now been found that the effects of fluctuating humidity can be neutralized by adjusting the viscosity of a waterborne coating as it is being conducted to the spraying device. A predetermined amount of water or other viscosity modifying additive may be mixed continuously with the coating in the coating supply line immediately upstream from the spray device. The amount of water or other additive to be added may be determined by monitoring the humidity in the spray zone. Preferably, an automated feedback control system is employed to adjust the amount of water or other viscosity altering additive being mixed into the coating stream in response to the measured humidity.

In accordance with the present invention, there is provided a method of applying waterborne coating compositions onto a substrate under varying humidity conditions comprising measuring relative humidity in the spray area to which a stream of waterborne coating composition is being supplied, using the relative humidity measurement as a basis for selecting the proportions of coating and a viscosity altering additive to be mixed together in the supply stream, and continuously mixing the selected amount of additive into the coating to obtain an adjusted formulation of the waterborne coating composition which is then sprayed onto a substrate in the spray area.

The present invention accomplishes humidity related formulation changes by an inline method. By "inline" is meant that the waterborne coating composition is adjusted as it moves along the coating supply line as the waterborne coating is being conveyed to the spray device. The formulation changes are accomplished continuously rather than by batch adjustment. As a result, there is no waste and little or no lag in adjusting to changing conditions.

Also in accordance with the present invention, there is provided an apparatus for applying waterborne coating compositions to a substrate comprising a spraying device in a spray area, a relative humidity sensor situated in the spray area, a coating supply line, one or more additive supply lines, means for controlling proportionate flow rates of the coating and the additive or additives, means for mixing the additive into the coating, control means for receiving an input from the relative humidity sensor and outputting a signal to the flow proportioning means, a fluid line for directing the mixed coating and additive stream to a spray device in the spray area.

Coated articles prepared in accordance with the invention are characterized by their acceptable appearance, being substantially free from pops and sags, and exhibiting a smooth surface.

THE DRAWING

FIG. 1 is a schematic diagram of an embodiment of the invention showing an arrangement for carrying out a continuous, humidity-responsive waterborne coating spray process in accordance with the invention.

DETAILED DESCRIPTION

The present invention will be described with reference to the embodiment depicted in the drawings but it should be understood that the invention is not limited to this particular embodiment.

The present invention encompasses a method of inline adjustment of waterborne coatings compositions held, for example, in reservoir 1 to compensate for the relative humidity of the environment in which the waterborne coating is being applied in a spray zone 13. The composition of the coating is not critical; the performance of any commercially available waterborne coating composition may be enhanced by this invention. In one mode of operation in accordance with the present invention, the base waterborne coating composition may be formulated for high relative humidity conditions, and the viscosity is adjusted downwardly as relative humidity drops. For this purpose, high humidity may be considered relative humidities of 80 percent or higher. Usually when a waterborne coating is formulated for application at high humidity only small amounts of water are used to reduce the coating to its spray viscosity, or no reduction is used. The viscosity of a reduced formulation for spraying at high relative humidity may be 35 to 60 percent higher than the spray viscosity used at low relative humidity. As the relative humidity becomes lower, the formulation can be adjusted by the addition of one or more viscosity altering additives from reservoir 2 or 3. Alternatively, the base coating composition may be formulated for low humidity and its viscosity adjusted upwardly by the appropriate additive as relative humidity rises. Another variation may involve a base coating composition formulated for moderate humidity, and the viscosity may be adjusted either upwardly or downwardly with separate additives.

Most commonly, the viscosity altering additive is a viscosity reducing agent (e.g., water), but the use of viscosity increasing additives is also encompassed by the present inventions Viscosity altering agents include water, mixtures of water and organic solvent, amines, and mixtures of water and amine. Examples of organic solvents that can be used are glycol ethers such as ethylene glycol monohexyl ether, ethylene glycol monobutyl ether, diethylene glycol monobutyl ether, propylene glycol monobutyl ether, or propylene glycol monopropyl ether. Examples of amines that can be used are dimethanolamine, di-isopropanolamine, or triethylamine.

The present invention entails measuring the relative humidity of the spray area 13. The spray area 13 may be an open area or closed area such as a spray booth. By spray booth is meant any enclosed or semi-enclosed space that has been designed to accommodate the application of coatings materials. The relative humidity measurement can be accomplished manually with a sling psychrometer or with any commercially available humidity sensor 14. A sensor that is capable of transmitting an electrical output signal that corresponds to the measured relative humidity is preferred. For example Model HX93 Humidity and Temperature Sensor manufactured by Omega Engineering, Inc., Stamford, Conn. can be employed. The Model HX93 uses a thin-film polymer capacitor to sense relative humidity. Other commercial sensors utilizing either a resistive polymer, a dielectric, or an electrostatic capacitor polymer film can be used.

Relative humidity is the basis for selecting the amount of additive from reservoir 2 or 3 that is added to the waterborne coating composition from reservoir 1 to compensate for the effects of the relative humidity on the final appearance of the waterborne coating. The additive is preferably deionized water, but may be a mixture of water and organic solvent, or a mixture of water and amine. In another envisioned mode of the invention the additive can consist of the waterborne coating composition that has been reduced with water to a very low viscosity. Additionally, more than one additive stream can be used.

Control of the proportioning of the additive(s) and the waterborne coating composition can be accomplished by various means. The control can be accomplished manually or by automated means. In one mode, a constant flow rate of the waterborne coating may be maintained, and the flow rate of the additive may be varied in accordance with the particular relative humidity. The flow rates can be monitored by flow meters 4, 5, and 6, which may be any commercially-available flow meter such as a ZHM Series or HPM Series Flow Meter distributed by AW Company, Racine, Wis., or a Model D6 Mass Flow Meter manufactured by Micro Motion, Inc., Boulder, Colo. The ZHM Series and HPM Series meters are positive displacement, gear flow meters, while the Micro Motion D6 is a mass flow meter that measures the vibrations of a U shaped sensor tube and equates the vibrational forces to fluid forces which are proportional to the mass flow rate. In preferred embodiments, proportional flow control may utilize a commercially available proportioning system, for example Model 2K™ Dual Component Metering System manufactured by DeVilbiss-Ransburg Industrial Liquid Systems,Inc., Toledo, Ohio. The 2K™ Dual Component Metering System is a micro-processor based analog closed loop fluid control device 12 incorporating flow meters 4, 5, 6 and servo valves 7, 8, 9 and providing continuous regulation of the fluid flow and mixing process. The unit uses ZHM Series flow meters. Preferably the proportioning equipment is capable of receiving a signal from the humidity sensor that is located in the spray booth, and is capable of selecting and setting the proper mixing ratio of additive to waterborne coating composition as determined for the particular relative humidity Because the viscosity characteristics and spraying behavior differ from one coating composition to another, determining the mixing ratios of additive to waterborne coating composition are determined empirically. Varying amounts of additive are mixed into the waterborne coating composition and an optimized ratio is determined for each range of relative humidity by choosing the ratio that produces the optimum film that is substantially free of defects such as sagging, popping, mottling, or exhibiting a dry rough surface that is evidence of poor leveling and flow.

The additive is mixed inline with the waterborne coating composition. Any method of mixing the additive and the waterborne coating will suffice, but preferably a static mixer 10 is used, for example the 140 Series Spiral Mixers manufactured by TAH Industries, Inc, Robbinsville, N.J. Static mixers consist of a series of baffles aligned in a tube. The baffles convert the tube into a maze and when fluids are pumped through the mixer, they are progressively divided and recombined resulting in efficient, inline mixing.

After mixing the additive with the waterborne coating composition, the adjusted formula can then be sprayed onto the surface to be coated by means of any commercially available spray device 11, such as a conventional air atomizing spray device, an electrostatic air atomizing spray device, or an electrostatic rotary atomizing device. The spray device may be operated in its normally accepted manner.

The invention is an inline process, not a batch adjustment process. By adjusting the formulation inline on a continuous basis the ability to spray over a wide range of relative humidities can be accomplished with no waste and no additional inventory.

EXAMPLE 1

A waterborne primer composition was spray applied to test panels utilizing a rotary atomizer equipped with a charging ring. The rotary atomizer used was a Behr Bell with an attached charging ring which is manufactured by Behr Industrial Equipment, Rochester, Mich. The operating parameters of the bell were:

| | | |
|---|---|---|
| Bell Speed | 40,000 | RPM |
| Shaping Air | 45 | psig |
| Voltage | 60 | KV |
| Bell to Target Distance | 11 | Inches |
| Conveyor Speed | 11 | Ft/Min |
| Paint Flow Rate | 180 | grams/min |

Temperature was held constant to within one degree of 73 degrees F. Experiments were conducted at 40% relative humidity (RH), 60% RH, and 80% RH. For each humidity level, test panels were coated with different amounts of water added continuously to the waterborne primer composition. At 40% RH panels were prepared with 0, 20, 30, 40, and 50 grams per minute of deionized water added inline to 180 grams per minute of waterborne coating. The primer and the water addition were passed through an inline static mixer just prior to entering the Behr Bell. At 60% RH panels were prepared with 0, 10, 20, and 30 grams per minute of deionized water added inline. At 80% RH panels were prepared with 0 and 10 grams per minute of deionized water added inline. Additional panels were prepared at 40%, 60%, and 80% RH with a pre-reduced control waterborne primer composition. The control composition was reduced to 24.8 second #4 Ford Cup with deionized water.

After spraying, all panels were flashed for five minutes at room temperature, then flashed for seven minutes at 175 degrees F., and then baked for 25 minutes at 325 degrees F. After baking, the panels were cooled and then film thickness and 60 degree gloss were measured. Also the surface appearance was evaluated visually using a scale of: very rough; rough; smooth; very smooth. Table 1 lists the results.

TABLE 1

| % RH | Water added grams/min | Thickness mils | 60° Gloss | Surface Evaluation |
|---|---|---|---|---|
| 40 | Control | 0.84 | 61 | Rough to Smooth |
| 40 | 0 | 0.90 | 65 | Very Rough |
| 40 | 20 | 0.68 | 37 | Rough to Smooth |
| 40 | 30 | 0.84 | 40 | Smooth |
| 40 | 40 | 0.80 | 56 | Smooth |
| 40 | 50 | 0.71 | 55 | Very Smooth |
| 60 | Control | 0.88 | 62 | Smooth |
| 60 | 0 | 0.91 | 70 | Rough |
| 60 | 10 | 0.80 | 55 | Rough to Smooth |
| 60 | 20 | 0.80 | 55 | Smooth |
| 60 | 30 | 0.73 | 54 | Very Smooth |

TABLE 1-continued

| % RH | Water added grams/min | Thickness mils | 60° Gloss | Surface Evaluation |
|---|---|---|---|---|
| 80 | Control | 0.86 | 55 | Smooth |
| 80 | 0 | 0.86 | 60 | Rough to Smooth |
| 80 | 10 | 0.71 | 62 | Smooth |

A waterborne primer composition was applied to test panels utilizing a rotary atomizer equipped with a charging ring as in EXAMPLE 1. The operating parameters of the bell were:

| | | |
|---|---|---|
| Bell Speed | 28,000 | RPM |
| Shaping Air | 40 | psig |
| Voltage | 60 | KV |
| Bell to Target Distance | 12 | Inches |
| Conveyor Speed | 14 | Ft/Min |
| Paint Flow Rate | 240 | grams/min |

Experiments were conducted at 25% RH, 40%RH, 60% RH, and 80% RH. The waterborne coating composition flow rate was 240 grams per minute. The deionized water addition was varied from 0 to 30 grams per minute. After spraying, the test panels were flashed for 5 minutes at room temperature, then flashed for 7 minutes at 175 degrees F., then baked for 25 minutes at 325 degrees F. After baking, the panels were cooled and then film thickness and 60 degree gloss were measured. Also, surface roughness measurements were made using a #2100 Surfpro Optical Profiler manufactured by A.T.I. Systems, Inc., Madison Heights, Mich. The instrument divided the measured surface anomalies into two categories. Anomalies greater than 0.030 inches in width were quantified as orange peel, and anomalies less than 0.030 inches in width were quantified as texture or micro-roughness. Two readings were returned for each classification, frequency and amplitude. The amplitude is the average height of the anomaly in micro-inches ($10^{-6}$ inches). The frequency is in units of cycles per millimeter. The results are detailed in Table 2.

TABLE 2

| | $H_2O$ | % Wt. | Film | 60° | Orange Peel | | Texture | |
|---|---|---|---|---|---|---|---|---|
| % RH | g/min | Solids | mils | Gloss | Freq. | Ampl. | Freq. | Ampl. |
| 25 | 0 | 49.97 | 1.02 | 33.5 | 0.84 | 708 | 6.94 | 48 |
| 25 | 20 | 45.41 | 0.90 | 47.5 | 0.64 | 463 | 8.62 | 187 |
| 25 | 30 | 43.74 | 1.07 | 56.5 | 0.70 | 140 | 10.63 | 82 |
| 40 | 0 | 49.97 | 1.23 | 57.5 | 0.65 | 400 | 8.93 | 199 |
| 40 | 5 | 49.51 | 1.10 | 60.3 | 0.64 | 371 | 9.17 | 164 |
| 40 | 10 | 47.49 | 1.26 | 59.0 | 0.65 | 218 | 10.20 | 125 |
| 40 | 15 | 46.27 | 1.22 | 61.5 | 0.70 | 194 | 10.20 | 102 |
| 40 | 20 | 45.41 | 1.29 | 60.0 | 0.62 | 168 | 10.41 | 92 |
| 40 | 25 | 45.18 | 1.01 | 59.3 | 0.72 | 151 | 9.80 | 93 |
| 60 | 0 | 49.97 | 1.20 | 62.1 | 0.57 | 231 | 9.90 | 114 |
| 60 | 5 | 49.51 | 1.22 | 63.9 | 0.62 | 149 | 10.74 | 78 |
| 60 | 10 | 47.59 | 1.11 | 62.9 | 0.64 | 143 | 10.20 | 80 |
| 60 | 15 | 46.27 | 1.10 | 64.9 | 0.71 | 126 | 10.98 | 71 |
| 80 | 0 | 49.97 | 1.09 | 61.6 | 0.75 | 125 | 10.74 | 83 |
| 80 | 5 | 49.51 | 1.09 | 62.6 | 0.75 | 124 | 11.11 | 76 |

Other variations and modification as would be apparent to those of in the art may be resorted to without departing from the scope of the on as defined by the claims that follow.

We claim:

1. A method of applying waterborne coating compositions onto a substrate under varying humidity conditions comprising:

(a) measuring relative humidity in the spray area in which a stream of waterborne coating composition is being supplied to a spray device;

(b) based on the relative humidity measurement controlling the proportionate flow rates of the stream of waterborne coating and an aqueous additive to be mixed into the waterborne coating composition stream, wherein the additive comprises a waterborne coating composition substantially the same as the waterborne coating composition stream but at a different water content than the waterborne coating composition stream;

(c) mixing the additive into the waterborne coating composition stream at the proportionate flow rates selected in step (b) to obtain an adjusted formulation of the waterborne coating composition;

(d) spraying the adjusted waterborne coating composition onto the substrate that is to be coated in the spray area.

2. The method of claim 1 in which the spraying is carried out with a air atomized spray device, an electrostatic air atomized spray device, or an electrostatic rotary atomizing device.

3. The method of claim 1 wherein the additive water content is lower than that of the waterborne coating composition stream.

4. The method of claim 1 wherein the additive water content is higher than that of the waterborne coating composition stream.

* * * * *